US006428643B1

(12) United States Patent
Bergquist et al.

(10) Patent No.: US 6,428,643 B1
(45) Date of Patent: Aug. 6, 2002

(54) METHOD AND APPARATUS FOR CASTING A PLUMBING FIXTURE

(75) Inventors: Walter S. Bergquist, Plymouth; Frank P. Williams, Sheboygan Falls, both of WI (US); Harold A. Teague, Blanket, TX (US)

(73) Assignee: Kohler Co., Kohler, WI (US)

( * ) Notice: Subject to any disclaimer, the term of this patent is extended or adjusted under 35 U.S.C. 154(b) by 0 days.

(21) Appl. No.: 09/443,513

(22) Filed: Nov. 19, 1999

(51) Int. Cl.[7] ..... B28B 1/26

(52) U.S. Cl. ..... 156/89.11; 156/242; 156/245; 264/86; 264/87

(58) Field of Search ..... 156/89.11, 500, 156/245; 425/84, 85, 234, 338, 451, 454; 264/86, 87

(56) References Cited

U.S. PATENT DOCUMENTS

| | | | | |
|---|---|---|---|---|
| 2,175,730 | A | 10/1939 | Laschenski | |
| 2,449,249 | A | 9/1948 | Pieslak et al. | |
| 2,565,356 | A | 8/1951 | Crane et al. | |
| 3,448,497 | A | 6/1969 | Arnold et al. | 25/29 |
| 3,664,799 | A | 5/1972 | Wallick, Jr. et al. | 425/389 |
| 3,671,160 | A | 6/1972 | Derror | |
| 4,296,908 | A | 10/1981 | Lippa | 249/58 |
| 4,591,472 | A | 5/1986 | Gerster | |
| 4,744,741 | A | 5/1988 | Glover et al. | |
| 4,798,525 | A | 1/1989 | Sato et al. | |
| 4,913,640 | A | 4/1990 | Spieler et al. | |
| 4,948,087 | A | 8/1990 | Hisaeda et al. | |
| 5,083,911 | A | 1/1992 | Hisaeda et al. | |
| 5,156,855 | A | 10/1992 | Hisatomi et al. | |
| 5,299,624 | A | 4/1994 | McKinney, Sr. | |
| 5,741,388 | A | 4/1998 | Gerster et al. | 156/245 |

FOREIGN PATENT DOCUMENTS

| | | |
|---|---|---|
| DE | 197 25 107 C 1 | 10/1998 |
| EP | 0 999 021 A2 | 10/1999 |
| JP | 03067606 | 3/1991 |

OTHER PUBLICATIONS

A Sama Maschinenbau GmbH advertisement, undated, admitted prior art, entitled "WC—High Pressure Casting" teaching multiple part molds for casting toilets right side up.

A Porvair 1992 advertisement entitled "Pressure Casting Machine".

A Sama 1999 proposal to Applicant based on Applicant's prior discussion of the concepts of the present invention with Sama. Hence, Sama derived relevant portions of its content from Applicant.

*Primary Examiner*—Richard Crispino
*Assistant Examiner*—Cheryl N Hawkins
(74) *Attorney, Agent, or Firm*—Quarles & Brady LLP

(57) ABSTRACT

A method of casting toilets and the like where the bowl and rim are separately molded and then connected together while both are in an upside down position. During the connection of the rim to the bowl, the bowl is preferably supported on two opposing sides by the mold. These procedures reduce deformation of the cast bowl while it is still in a "greenware" condition. An apparatus for carrying out this method in an automated manner is also disclosed.

7 Claims, 8 Drawing Sheets

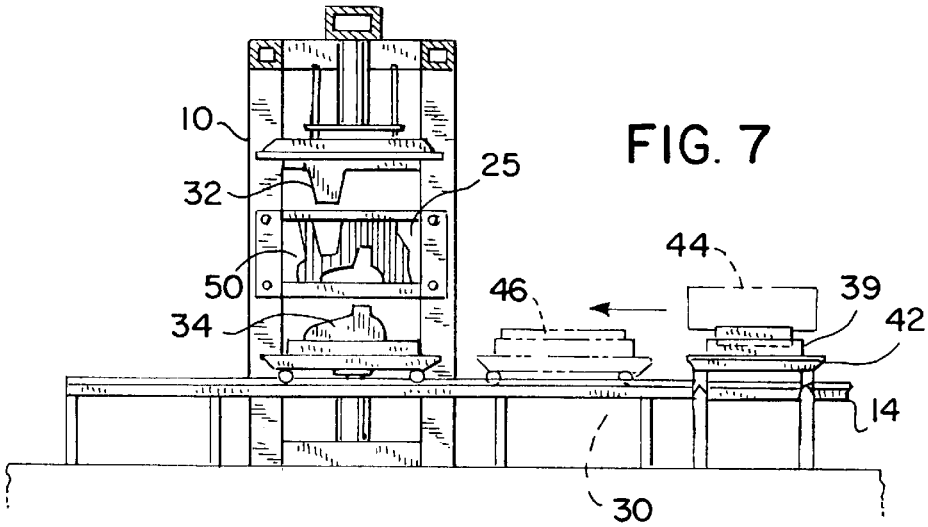
FIG. 7
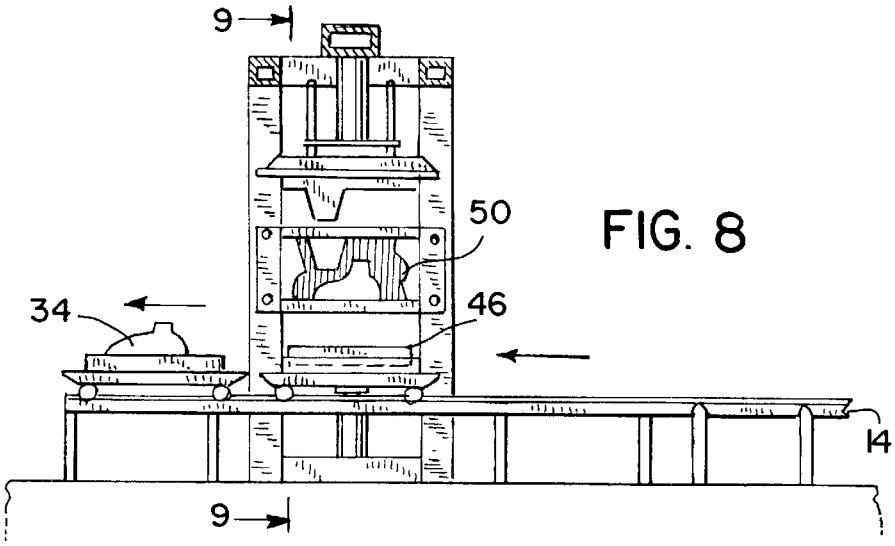
FIG. 8
FIG. 9
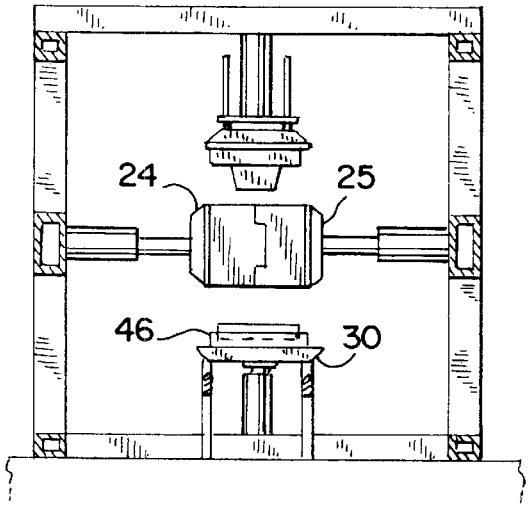
FIG. 10
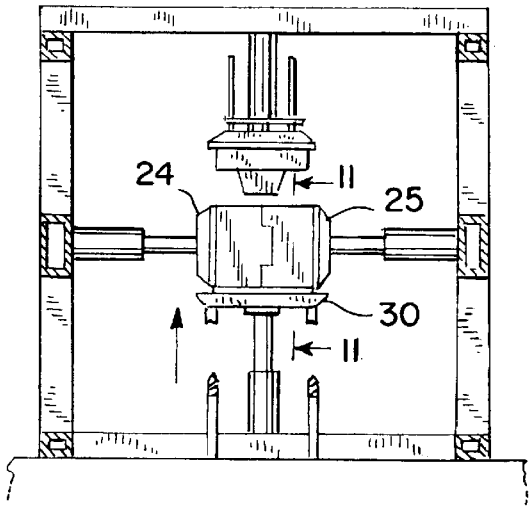

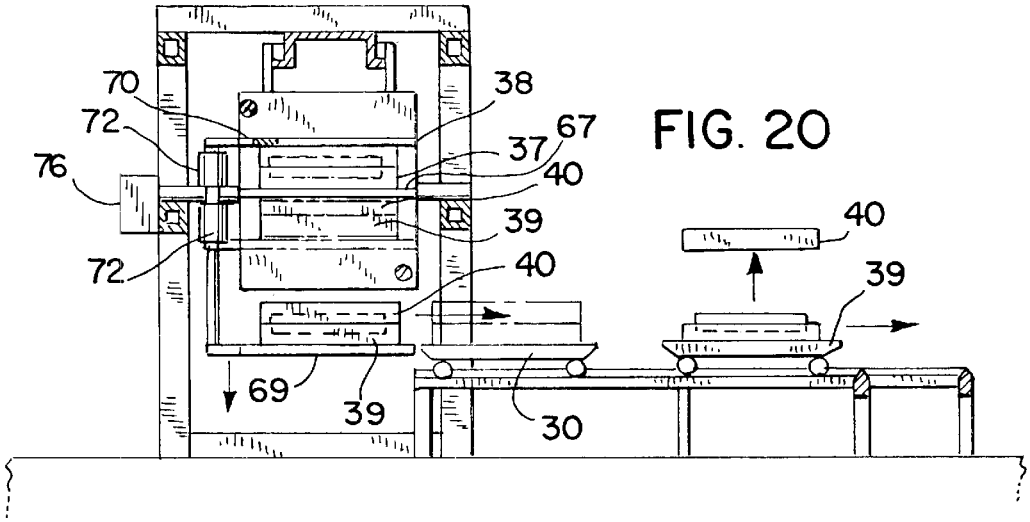
FIG. 20
FIG. 15A
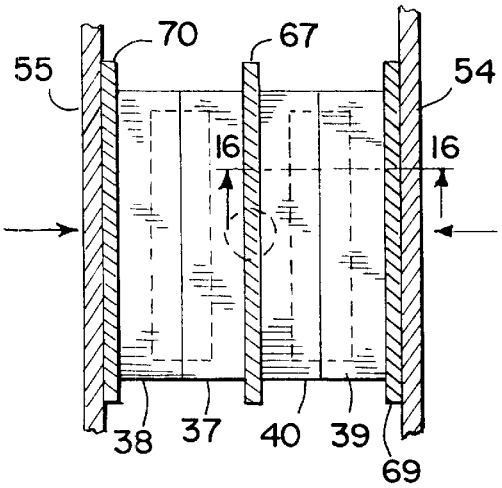
FIG. 19A
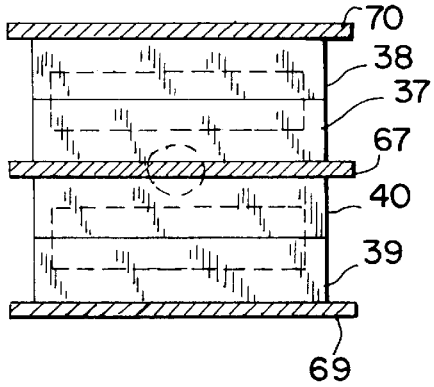
FIG. 19B
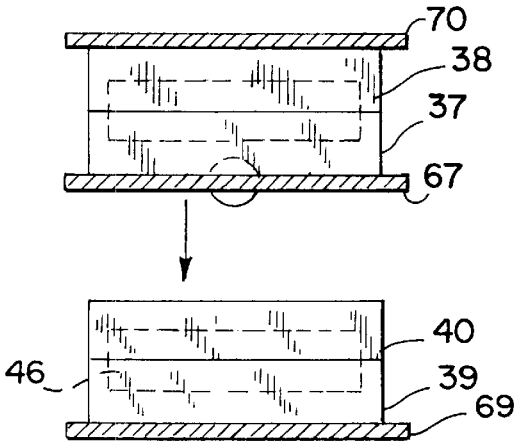
FIG. 20A
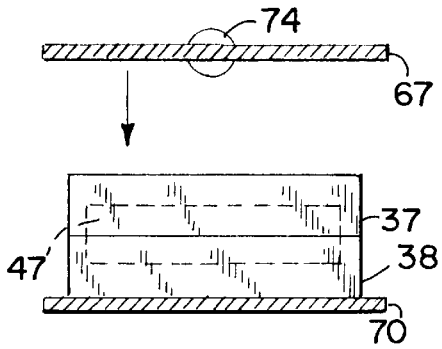

FIG. 21
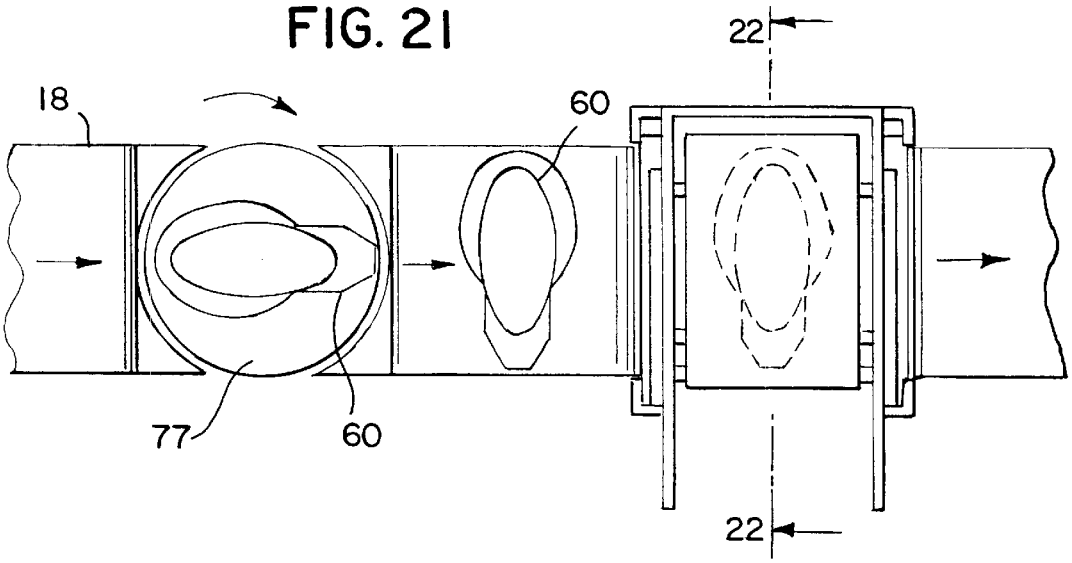
FIG. 23
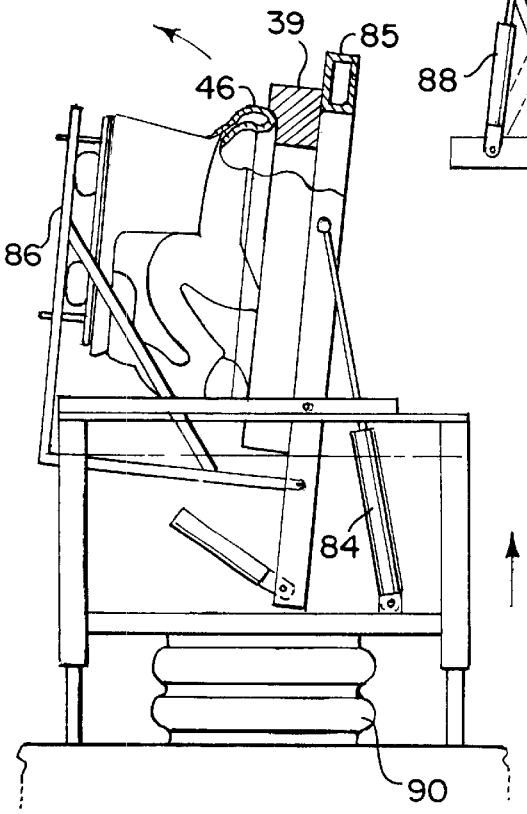
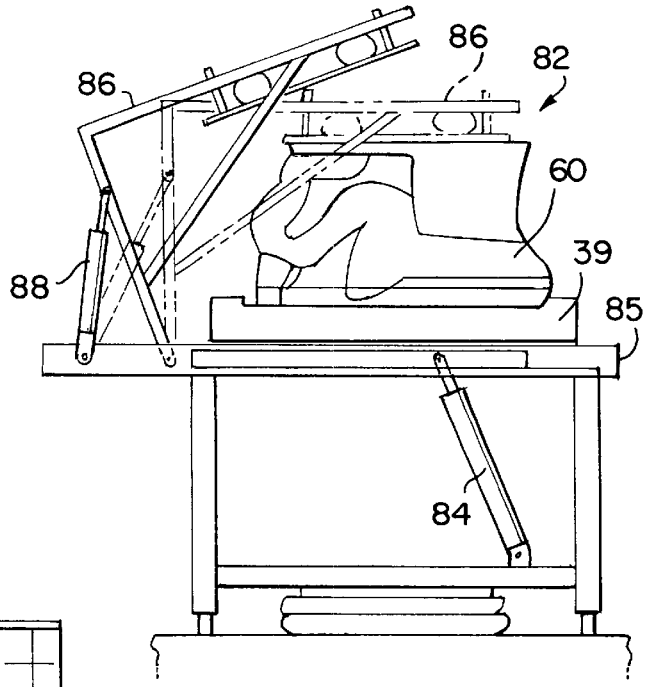
FIG. 22

METHOD AND APPARATUS FOR CASTING A PLUMBING FIXTURE

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

The present invention relates to techniques for casting plumbing fixtures. It is especially well suited for casting toilet bowls having substantially closed rims.

Toilets have often been cast from ceramic slurries. Typically, the slurry was placed in a porous mold which caused the ceramic material to deposit along the mold walls due to capillary attraction through mold pores. As a hollow remained inside of the material that had been deposited on the mold walls, excess slurry could be drained from the mold interior to clear trapways and other water pathways.

The newly-formed fixture was referred to as "greenware". "Greenware" more generally refers to an unfired ceramic, usually one with substantial moisture content, regardless of the color of the item. The greenware toilets were then typically allowed to air dry and then fired in a kiln.

Various types of automated equipment for casting ceramic plumbing fixtures are known (e.g. U.S. Pat. No. 4,948,087—lavatories; U.S. Pat. No. 5,299,624—toilets). Such equipment can close, pressurize, drain, and open multiple molds to form multiple plumbing fixtures or fixture parts at the same time. With respect to toilets, such equipment works best for toilets that are designed with open rim bottoms. When the toilet rim is designed with a closed bottom, this type of molding requires the rim and bowl to be molded separately (and then joined together, preferably while the two pieces of greenware are still soft). See generally U.S. Pat. No. 2,565,356. Unfortunately, the weight of rims is sometimes so great that this process can cause bowl walls to deform during the process unless extreme care is used (thereby slowing the process considerably).

To date the prior art had not provided an optimal solution for this problem. The art has been accepting a certain amount of waste, deformity, and/or slower production rates. Thus, it can be seen that a need exists to develop improved techniques for casting such items.

BRIEF SUMMARY OF THE INVENTION

In one aspect the invention provides a method for casting a plumbing fixture having a bowl and a rim. One casts a bowl portion of a plumbing fixture, and a rim portion of the plumbing fixture separately from the bowl portion. One then places the rim portion in contact with the bowl portion when both are upside down and both are greenware. Thereafter, one allows the bowl portion and rim portion to bond together and dry.

In preferred methods the casting of the bowl portion involves the use of multiple mold parts to form the bowl portion, followed by removal of a bottom one of the mold parts while the bowl portion is in an upside down position. The plumbing fixture can be a toilet having a rim with an at least partially closed bottom.

In other preferred aspects, the bowl portion is cast in a four part mold supported by a press unit. The components of the press unit control the position of two side mold parts in a manner such that they can continue to support the cast bowl portion upside down when the top of the bowl portion is exposed.

In another form the invention provides a molding apparatus for casting a plumbing fixture having a bowl and rim. There is a frame member, a top mold part, two side mold parts and a bottom mold part. The mold parts are capable of forming an upside down portion of a plumbing fixture when the mold parts are in a molding position.

There are also mold reciprocating members connected to the mold parts and to the frame member to move the mold parts between the molding position and retracted positions in an automated manner. The mold reciprocating members and the mold parts are constructed and arranged so as to be able to move the bottom mold part down relative to the side mold parts when the side mold parts are still in the molding position.

Preferably the mold reciprocating members include hydraulic rams. The mold reciprocating members and the mold parts can be constructed and arranged to move both the top and bottom mold parts away from the side mold parts while the side mold parts are still in the molding position. When the molding apparatus forms a bowl, the molding apparatus can be used with a rim support member capable of moving a rim into contact with the bowl after the bottom mold part is moved away from the side mold parts and while the bowl is still at least partially between the side mold parts. The apparatus can also include a conveyor extending below a bottom of the molding apparatus.

In still another form the invention provides cast plumbing fixtures produced by the above methods.

It will be appreciated that the invention reduces deformities (and associated waste) that are caused by conventional methods of casting and assembling such toilets. Deformities are further reduced when using the present invention because the most fragile portions of the bowl wall remain supported by mold parts when the bowl is first pressed onto the rim. Equipment for facilitating the automation of these methods is also provided.

The invention therefore provides:

a. a method for casting a toilet bowl and rim (and analogous plumbing fixtures such as a lavatories and bath tubs) wherein the incidence of deformation of the bowl during assembly of the toilet parts is substantially reduced;

b. a method for casting such fixtures which lends itself to automation and increased rates of production; and c. an apparatus which can carry out the method described herein.

These and still other advantages of the present invention will be apparent from the description which follows. In the detailed description below preferred embodiments of the invention are described with reference to the accompanying drawings. These embodiments do not represent the full scope of the invention. Rather the invention may be employed in other embodiments. Reference should therefore be made to the claims herein for interpreting the full breadth of the invention.

BRIEF DESCRIPTION OF THE DRAWINGS

FIG. 7 is a cross sectional view taken along line 7—7 of FIG. 6;

FIG. 8 is a view similar to FIG. 7, albeit showing the bottom mold part in process of being replaced with a separately molded rim;

FIG. 9 is a view taken along line 9—9 of FIG. 8;

FIG. 10 is a view similar to FIG. 9, showing the separately formed rim being lifted upside down for attachment to the upside down bowl;

FIG. 15A is a view taken along line 15A—15A of FIG. 15;

FIGS. 19A, 19B and 20A are sectional views illustrating stages of unloading the rim from the casting machine;

FIG. 20 is a view similar to FIG. 15, albeit showing the unloading of the cast rim;

FIG. 21 is a top view illustrating a turning of the largely dry cast toilet for further processing;

FIG. 22 is a view taken along line 22—22 of FIG. 21; and

FIG. 23 is a view similar to FIG. 22, albeit showing the cast toilet further flipped.

DETAILED DESCRIPTION OF THE INVENTION

Figure 1:
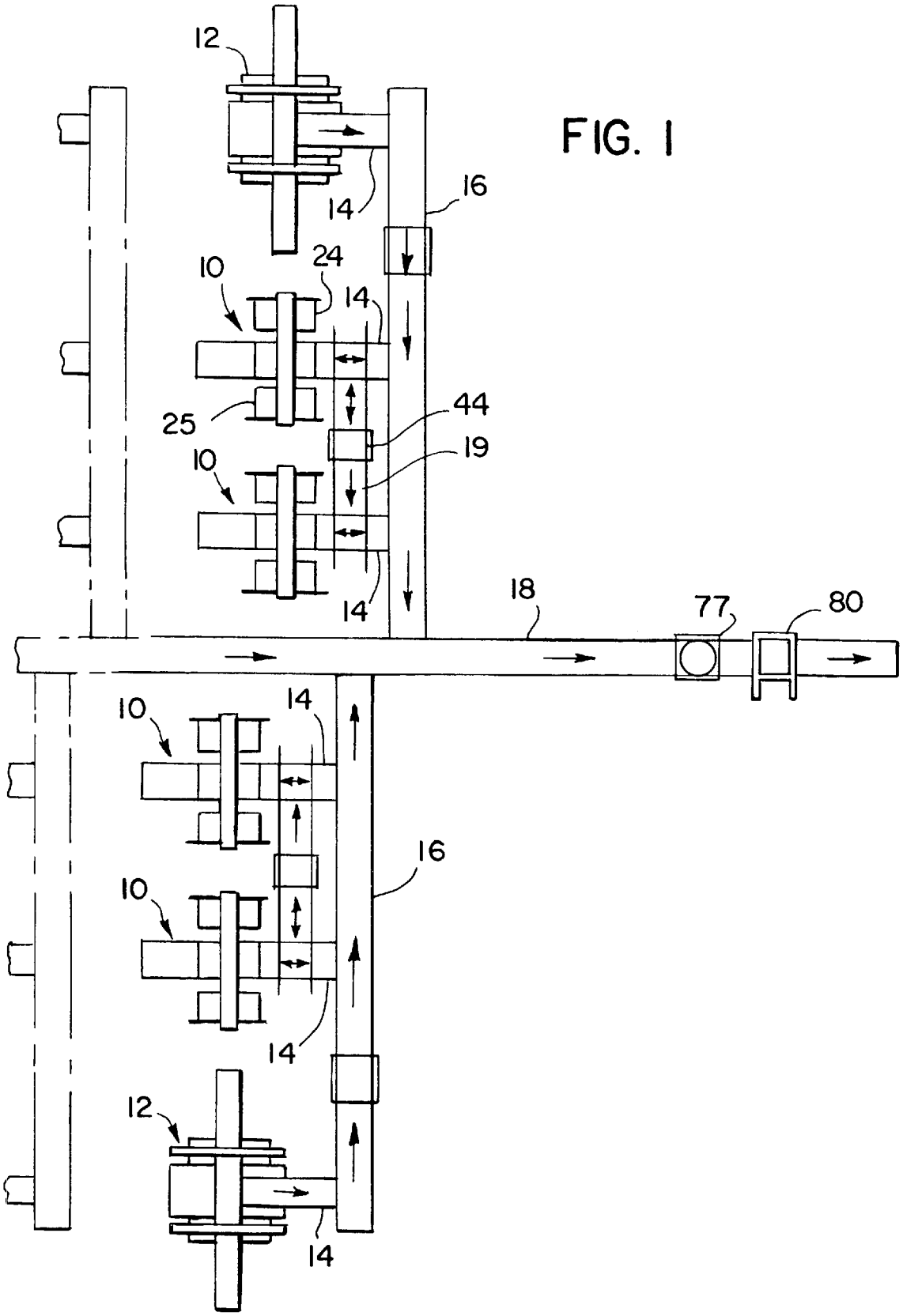
FIG. 1 is a schematic view of a plant layout showing, among other things, an apparatus for conducting a preferred method of the present invention.
Figure 2:
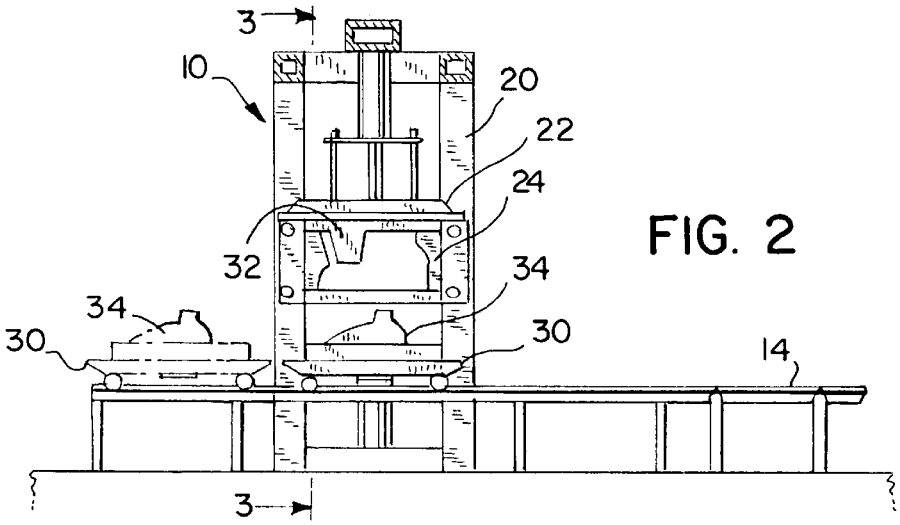
FIG. 2 is a schematic, front elevational view of a molding machine of the present invention, showing the machine prior to molding and with the bottom mold part in a retracted position.
Figure 3:
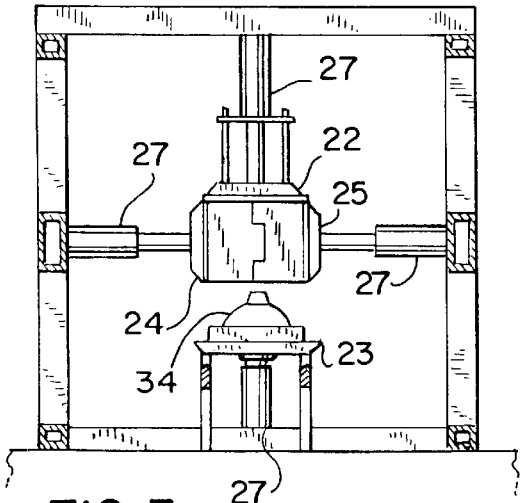
FIG. 3 is a view taken along line 3—3 of FIG. 2.
Figure 4:
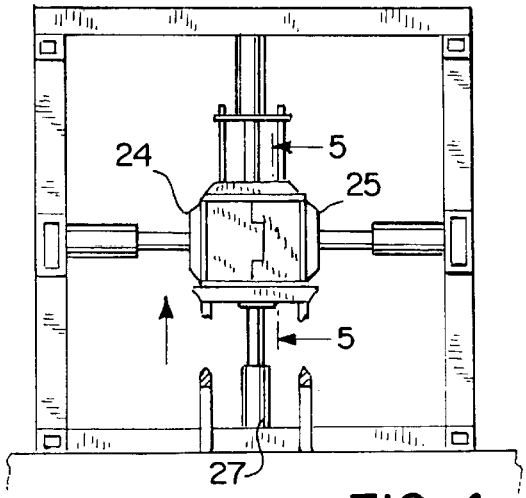
FIG. 4 is a view similar to FIG. 3, albeit showing the machine in a closed molding stage.

As shown in FIG. 1, the casting method of the present invention can be carried out using toilet bowl casting machines 10 and rim casting machines 12. While the machines form bowl and rim portions separately, they are interconnected by conveyor tracks 14, 16 and 18. Tracks 14 transport products from the casting machines to lateral conveyor tracks 16, which in turn feed conveyor track 18.

Referring primarily to FIGS. 2–6, a toilet bowl casting machine 20 includes an upper mold clamp 22 to which is connected top mold part 32, and a lower mold clamp 23 to which is connected bottom mold part 34. There are also side mold parts 24 and 25. The mold parts are moved inwardly and outwardly by the hydraulic rams 27. The bottom mold part 34 can be stored on a trolley 30 which can move on track 14 to position bottom mold part 34 on mold clamp 23. With mold parts 32, 24 and 25 already in position, mold part 34 can then be raised into a totally closed mold position by ram 27 (see FIG. 5).

A conventional ceramic slip casting material is fed under pressure into the mold parts through the channel 26. As will be understood by those familiar with conventional slip casting, this can form bowl portion 50. Formation of the trapway 29 in the bowl portion is further facilitated by using pressurized air. Excess slip can then be removed.

Figure 6:
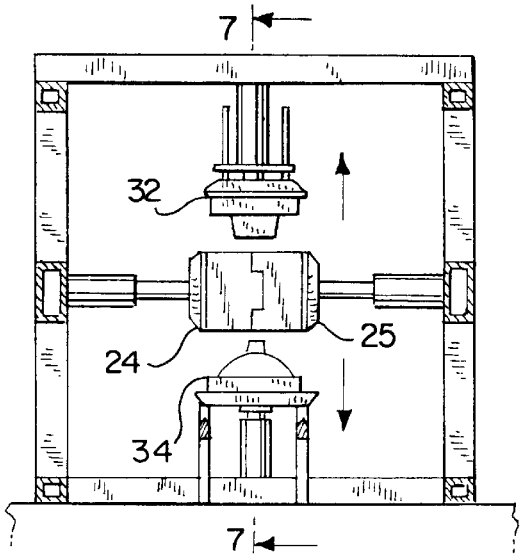
FIG. 6 is a view similar to FIG. 3, albeit showing the machine with the top and bottom mold parts being retracted after bowl portion molding.
Figure 5:
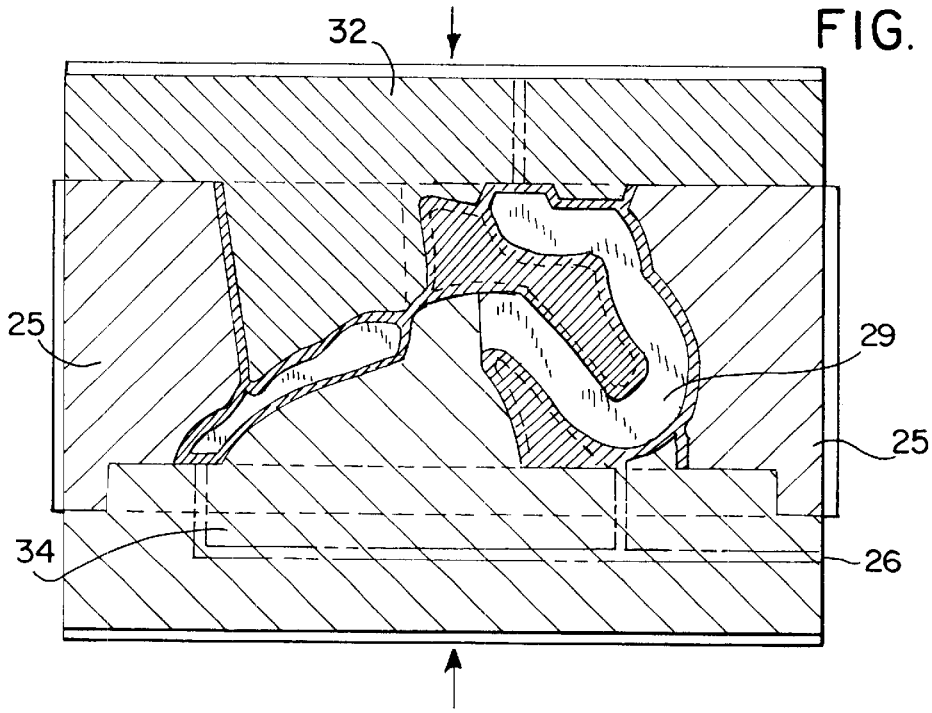
FIG. 5 is a cross sectional view taken along line 5—5 of FIG. 4.
Figure 16:
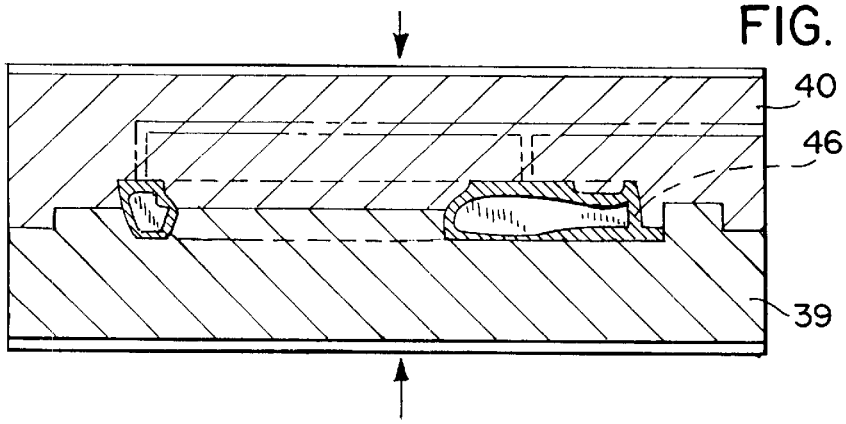
FIG. 16 is a view taken along line 16—16 of FIG. 15A, illustrating the molding of a rim in one of the multiple casting molds.

Subsequent to the casting of the bowl, the top and bottom mold parts 32 and 34 are withdrawn (see FIG. 6). The cast greenware bowl 50 is still at this point held upside down above the conveyor track 14 by the side mold parts 24 and 25. While the bowl 50 is in an upside down position, the bottom bowl mold 34 is moved out from under casting machine 10 (see FIG. 8).

Figure 11:
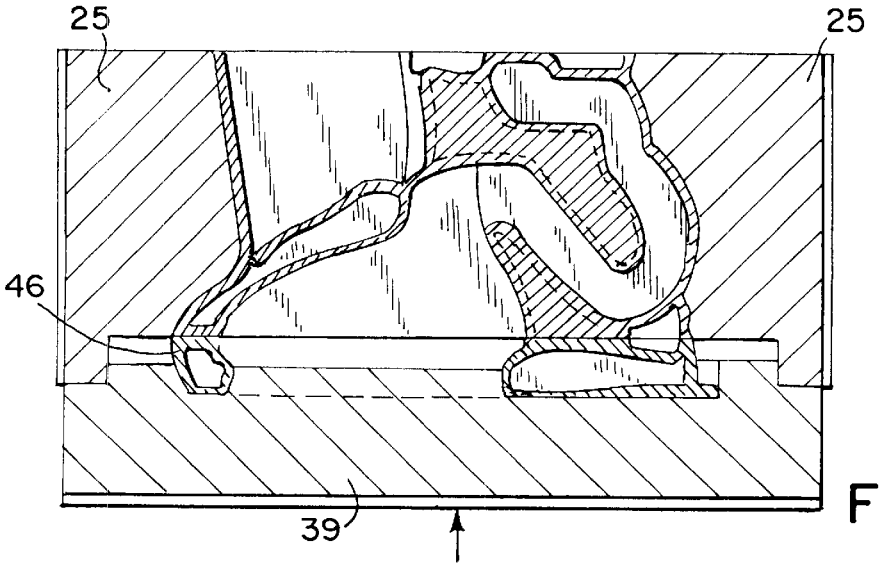
FIG. 11 is a view taken along line 11—11 of FIG. 10, showing the bowl and rim being positioned adjacent each other.

An upside down separately cast rim 46 takes its place (FIG. 9) and has slip material applied to its lower surface (which faces up as the rim is upside down when this occurs). Rim 46 is then raised on trolley 30 as illustrated in FIG. 10 so that the bottom surface of the rim 46 is brought into contact with the top surface of the bowl 50 (when both are upside down). This results in a cast greenware toilet as shown in FIG. 11, albeit preferably at this point the toilet is still supported by the side mold parts.

Figure 12:
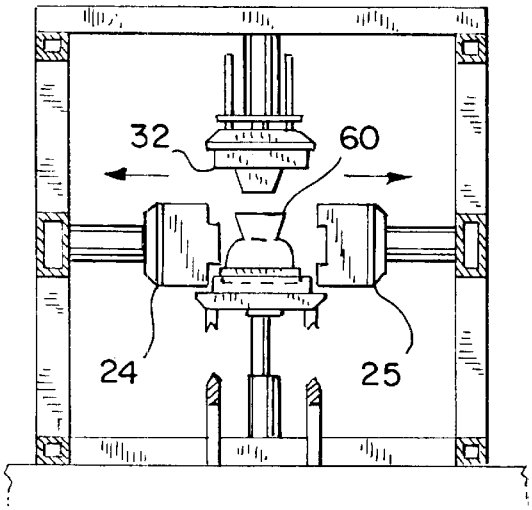
FIG. 12 is a view similar to FIG. 9, albeit showing the side molds retracted and the bowl resting upside down on the upside down rim.

The next step is the release of the cast toilet from the side mold parts. This is shown in FIG. 12. This step can be delayed if desired. However, typically no such delay is needed.

Figure 13:
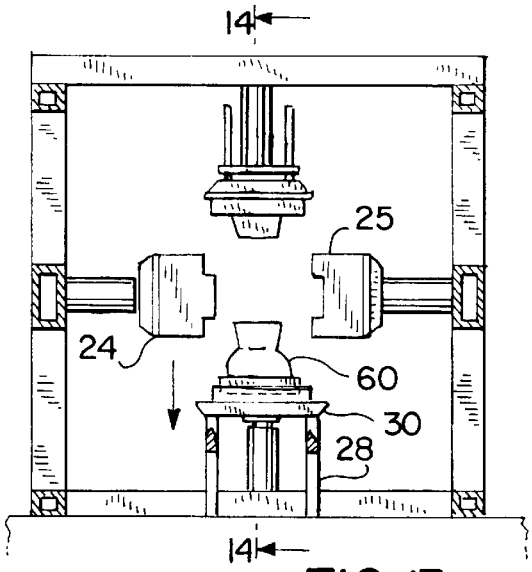
FIG. 13 is a view similar to FIG. 9, albeit showing the toilet having been lowered below the mold parts.
Figure 14:
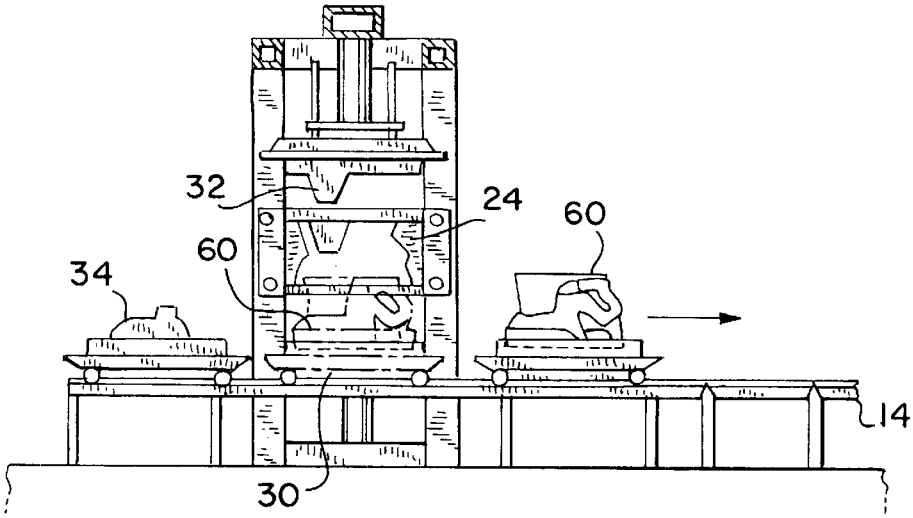
FIG. 14 is a view taken along line 14—14 of FIG. 13.

The cast toilet 60 is then lowered on trolley 30 by the ram 27 with guides 28 as shown in FIG. 13. It is moved over track 14 (as shown in FIG. 14) to track 16, and then ultimately onto track 18. At this point it is turned 90 degrees on a vertical axis on turntable 62 after which excess mold material can be removed at finishing station.

Figure 17:
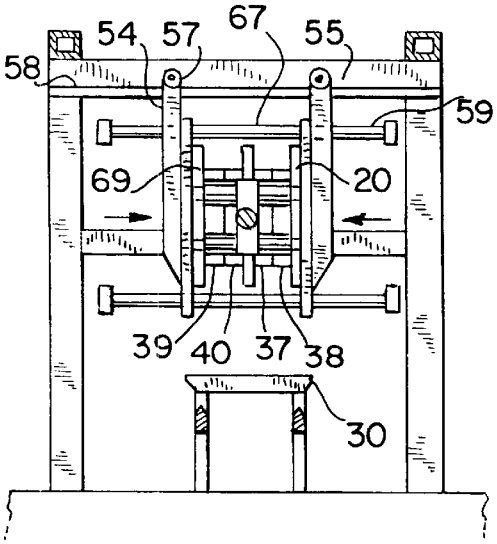
FIG. 17 is a view taken along line 17—17 of FIG. 15.

The separate casting of rim 46 is illustrated in detail in FIGS. 15–20A. The rim casting machine 12 includes a frame 52 upon which are slidably supported two clamping clam members 54 and 55 by means of upper rollers 57 and tracks 58. They are guided by rods 59 and serve to hold two or more pairs of rim mold halves 37/38 and 39/40 in place. A central plate 67 and two side plates 69 and 70 are sandwiched by the clam members 54 and 55 against the mold halves 37, 38 and 39, 40. This is seen in FIG. 17 and is the position wherein the casting material is introduced into the mold halves 37, 38 and 39, 40.

Figure 18:
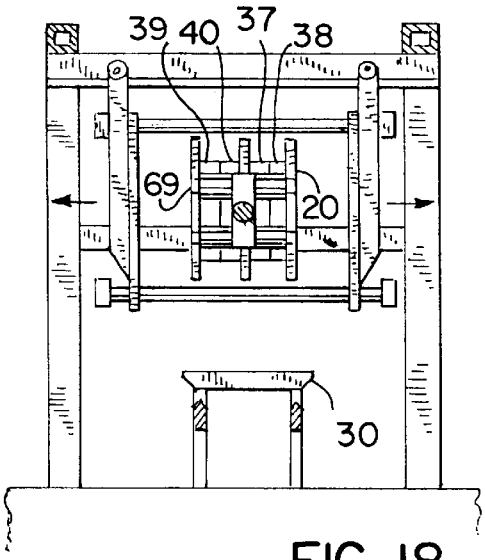
FIGS. 18 and 19 are views similar to FIG. 17 showing the casting machine in further stages of operation.

After the casting step, the clam members are moved away from the mold halves 37, 38 and 39, 40 as shown in FIG. 18. The mold halves are held in place by the hydraulic rams 72 connected to plates 69 and 70. See generally FIGS. 15 and 20.

Figure 15:
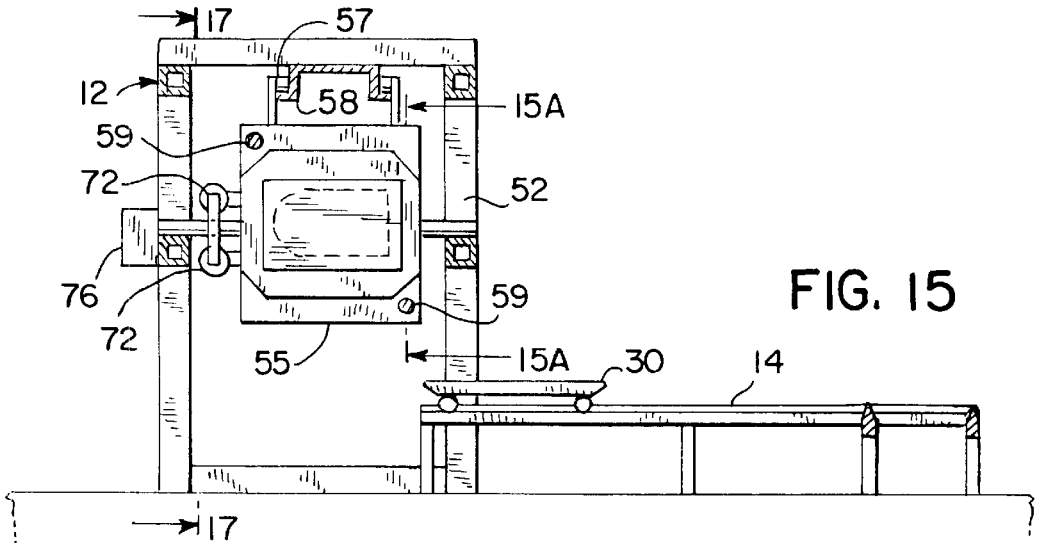
FIG. 15 is a front view of the rim casting machine.
Figure 19:
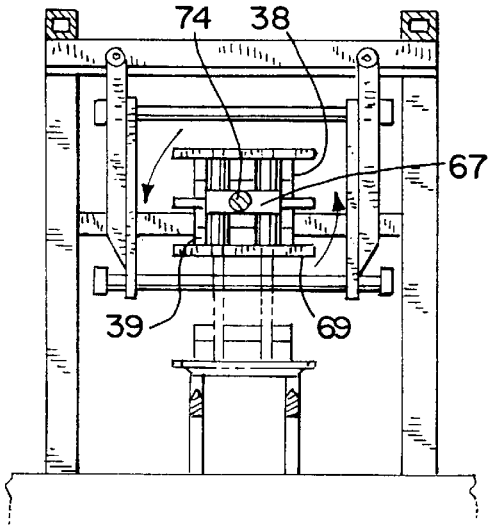

The next step is the 90 degree rotation of the molds and the unloading from the casting machine. This is seen in FIG. 19 and is further illustrated in conjunction with FIGS. 15A, 19A, 19B and 20A. It is accomplished by the rotation of shaft 74 connected to central plate 67. Shaft 74 is rotated by drive motor 76 (see FIGS. 15 and 20) to position the molds from the vertical to the horizontal as seen in FIGS. 15A and 19A.

With mold halves 39 and 40 positioned under plate 67 and supported by plate 69 as illustrated in FIG. 19B, mold halves 39 and 40 are lowered by hydraulic ram 72 and moved from plate 69 onto trolley 30. Mold halves 37 and 38 are unloaded by a 180 degree rotation of shaft 74 and lowered by hydraulic ram 72 in the same manner previously indicated for mold halves 39 and 40. This is seen in FIG. 20A. The mold tops 40 and 37 are removed, and the rims 46 and 47 are applied to a cast toilet as previously described in conjunction with FIG. 11.

After the molding of the cast toilet 60, it is further treated at a station 80. This is shown in FIGS. 21–23. The cast toilet 60 is positioned onto a lift apparatus 82. The lift apparatus includes a ram 84 for pivoting an open frame support 85 and flipping the cast toilet and rim 60 towards a more upright position as shown in FIG. 23 (where it is supported against support member 86 which in turn is pivoted by ram 88). Vertical height adjustment is afforded by the bellows 90.

This positioning allows trimming of mold material from the toilet 60 where in FIG. 22 it is trimmed from the outside, and in FIG. 23, it is trimmed from the inside. The trimmed toilet 60 is then placed on a trolley 30 and moved to a loading station where it is loaded on a drying track. Thereafter, the toilet is fired in a kiln in the usual manner.

An important feature of casting method and apparatus of this invention is the connection of the rim to the cast bowl when both are in an upside down position, partially supported by the mold, and still greenware. This reduces deformation of the bowl and resulting waste, and permits the use of faster production rates.

While certain preferred embodiments of the present invention have been described above, it should be apparent to those skilled in the art from the above description that a number of modifications and changes can be made without departing from the spirit and scope of the invention. For example, it would not be necessary to employ a finishing station 80. Neither is it necessary to have a rim casting machine 12 of the type disclosed which produced multiple rims in a single casting operation.

While the invention is particularly well suited for use with a closed rim 46, it could be used with an open one. Further, other molding apparatus could be employed to connect the rim to the toilet bowl. Therefore, it is intended that the scope of the invention not be limited solely by the description of the preferred embodiments.

INDUSTRIAL APPLICABILITY

The invention provides methods and equipment for producing plumbing fixtures such as toilets with reduced incidence of deformities and waste.

What is claimed is:

1. A method for casting a plumbing fixture having a bowl and a rim, comprising:

casting in an upside down position a bowl portion of a plumbing fixture;

casting a rim portion of the plumbing fixture separately from the bowl portion;

placing the rim portion in contact with the bowl portion when both are upside down, both are greenware and the bowl portion is in contact with side mold parts; and then allowing the bowl portion and rim portion to bond together and dry.

2. The method of claim 1, wherein the casting of the bowl portion comprises the use of multiple mold parts to form the bowl portion, followed by removal of a bottom one of the mold parts while the bowl portion is in an upside down position.

3. The method of claim 1, wherein the plumbing fixture is a toilet.

4. The method of claim 3, wherein the rim portion has an at least partially closed bottom.

5. The method of claim 1, wherein the bowl portion is cast in a four part mold.

6. The method of claim 5, wherein the four part mold is supported by a press unit.

7. The method of claim 6, wherein components of the press unit control the position of two side mold parts in a manner such that they can support the cast bowl portion upside down when the top of the bowl portion is exposed.

* * * * *